US007726082B2

(12) United States Patent
Hayes et al.

(10) Patent No.: US 7,726,082 B2
(45) Date of Patent: Jun. 1, 2010

(54) ANCHOR WEDGE CONFIGURATION FOR TENDON ANCHORS

(75) Inventors: Norris O. Hayes, Stafford, TX (US); Randy Draginis, Terrell, TX (US)

(73) Assignee: Hayes Specialty Machining Ltd., Sugar Land, TX (US)

( * ) Notice: Subject to any disclaimer, the term of this patent is extended or adjusted under 35 U.S.C. 154(b) by 94 days.

(21) Appl. No.: 11/004,281

(22) Filed: Dec. 4, 2004

(65) Prior Publication Data

US 2006/0117683 A1 Jun. 8, 2006

(51) Int. Cl.
*E04C 5/08* (2006.01)

(52) U.S. Cl. ..... 52/223.13; 52/223.6; 52/223.14; 405/259.1

(58) Field of Classification Search ..... 52/223.13, 52/223.14, 223.1, 223.4, 223.5, 223.2, 223.3, 52/223.6–223.12; 24/115 M, 122.3; 411/266–270; 254/29 A; 403/267, 367, 371, 374.1, 374.2, 403/374; 405/256.1–259.6
See application file for complete search history.

(56) References Cited

U.S. PATENT DOCUMENTS 2,177,364 A * 10/1939 Fotsch ..... 403/185
2,180,866 A * 11/1939 Cryer ..... 403/369
3,399,434 A * 9/1968 Kelly ..... 403/194
3,524,228 A * 8/1970 Kelly ..... 403/369
3,703,748 A * 11/1972 Kelly ..... 403/368
RE27,954 E * 4/1974 Kelly ..... 403/369
3,895,879 A * 7/1975 Burtelson ..... 403/369
3,912,406 A * 10/1975 McGrath ..... 403/19
4,707,890 A * 11/1987 Savall et al. ..... 24/122.6
5,141,356 A * 8/1992 Chaize ..... 403/368
5,369,849 A * 12/1994 De France ..... 24/136 R
6,023,894 A * 2/2000 Sorkin ..... 52/223.8
2002/0083659 A1 * 7/2002 Sorkin ..... 52/167.1

* cited by examiner

*Primary Examiner*—Richard E Chilcot, Jr.
*Assistant Examiner*—William V Gilbert
(74) *Attorney, Agent, or Firm*—Richard A. Fagin

(57) ABSTRACT

A wedge for a tendon retaining anchor includes at least two circumferential wedge segments adapted to be placed on an exterior of a tendon. The wedge segments have an exterior surface adapted to cooperate with a receiving bore of a load transfer device and an interior surface having gripping elements thereon. A circumferential dimension of the wedge segments is selected so that a total uncompressed gap between circumferential ends of the wedge segments when the segments are applied to an exterior surface of the tendon is at most about 2.4 times a height of the gripping elements. In another aspect, a tendon retaining system includes an anchor having a wedge receiving bore and wedge segments adapted to cooperate with the wedge receiving bore. The wedge segments include gripping elements on an interior surface thereof. The system includes a device adapted to limit lateral compression of the wedge segments.

30 Claims, 4 Drawing Sheets

ANCHOR WEDGE CONFIGURATION FOR TENDON ANCHORS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of tendon anchoring systems. More particularly, in one aspect the invention relates to post tension systems for reinforcing concrete structures.

2. Background Art

The present invention is described herein primarily with reference to post-tension anchoring devices and systems. However, the invention can be used in any application requiring retention of a tendon within an anchorage or other device which transfers tension from the tendon to another structure. Such applications include, without limitation, prestress chucks and couplers, post tensioning applications for bridges, post tension jacks, cable stay wedges, post tensioning applications for roads, bridge tie-backs, mine shaft wall and roof retainers, wall retainers and wall forming systems, multi head stressing jacks, heavy cable lifting systems, post tensioning slabs, barrier cable systems and single post tensioning rams.

As is relates to post-tension anchoring systems, the background of the invention can be described as follows. For quite some time, the design of concrete structures imitated typical steel structure designs of columns, girders and beams. With technological advances in structural concrete, however, designs specific to concrete structures began to evolve. Concrete has several advantages with respect to steel, including lower cost, not requiring fireproofing, and having plasticity, a quality that lends itself to free flowing or boldly massive architectural concepts. On the other hand, structural concrete, though quite capable of carrying almost any compressive (vertical) load, is essentially unable to carry significant tensile loads. In order to enable concrete structures to carry tensile loads, it is necessary, therefore, to add steel bars, called reinforcements, to the concrete. The reinforcements enable the concrete to carry the compressive loads and the steel to carry the tensile (horizontal) loads.

Structures made from reinforced concrete may be built with load-bearing walls, but this configuration does not use the full potential of the concrete. The skeleton frame, in which the floors and roofs rest directly on exterior and interior reinforced-concrete columns, has proven to be most economical and popular method of building concrete structures. Reinforced-concrete framing appears to be a quite simple form of construction. First, wood or steel forms are constructed in the sizes, positions, and shapes called for by engineering and design requirements. Steel reinforcing is then placed and held in position by wires at its intersections. Devices known as chairs and spacers are used to keep the reinforcing bars apart and raised off the form work. The size and number of the steel bars depends upon the imposed loads and the need to transfer these loads evenly throughout the building and down to the foundation. After the reinforcing is set in place, the concrete, a mixture of water, cement, sand, and stone or aggregate, of proportions calculated to produce the required compressive strength, is placed, care being taken to prevent voids or honeycombs.

One of the simplest designs for concrete frames is the beam-and-slab. The beam and slab system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be used over and over for the same shape. The beam and slab system, therefore, produces an economically advantageous structure.

With the development of flat-slab construction, exposed beams can be eliminated. In the flat slab system, reinforcing bars are projected at right angles and in two directions from every column supporting flat slabs spanning twelve or fifteen feet in both directions. Reinforced concrete reaches its highest potentialities when it is used in pre-stressed or post-tensioned members. Spans as great as 100 feet can be attained in members as deep as three feet for roof loads. The basic principle is simple. In pre-stressing, reinforcing rods of high tensile strength steel are stretched to a certain determined limit and then high-strength concrete is placed around them. When the concrete has set, it holds the steel in a tight grip, preventing slippage or sagging. Post-tensioning follows the same principle, but the reinforcing is held loosely in place while the concrete is placed around it. The reinforcing is then stretched by hydraulic jacks and securely anchored into place. Prestressing is performed with individual members in the shop and post-tensioning is performed as part of the structure on the construction site. In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

One such post tensioning system is described in U.S. Pat. No. 3,937,607 issued to Rodormer. The general principle is explained with respect to FIG. 3 in the '607 patent and states, in relevant part, "[i]n accordance with conventional techniques, a center hole electro-hydraulic jack is placed on each tendon to tension the tendon. When the jack is released the live end anchor chuck 40 will set and grip the tendon holding the latter at the desired tension." The retaining wedge known in the art is typically a conical-exterior shaped insert which fits in a mating, tapered opening in an anchor plate. The wedge may be divided into two or more circumferential segments to enable application to the exterior of the tendon or cable prior to insertion into the opening in the anchor plate. The interior opening of the wedge typically includes conventional buttress threads in order to deform and thus grip the exterior surface of the tendon or cable, such that when the jack or tensioning device is released, the tension in the tendon will be transferred to the wedge, and thus to the anchor plate (or other load transfer device).

Recently, certification procedures for the tensile strength of post tensioning devices promulgated by the Post Tension Institute (PTI) were amended to provide a new minimum standard for the absolute ultimate tensile strength (AUTS) of post tensioning anchoring devices. As a result of the new certification procedures, it has been determined that post tensioning anchoring devices known in the art fail certification testing in a substantial number of cases. The steel alloys used in post tensioning anchoring devices are already developed to such an extent that improving the tensile strength of the anchoring devices themselves would be difficult and expensive. Accordingly, there is a need for a configuration of a post tensioning anchor system, or tendon retaining system for use in other tension applications, which has improved anchoring strength using materials known in the art, and while substantially maintaining the dimensions of post tensioning and other tendon anchor systems known in the art.

SUMMARY OF THE INVENTION

One aspect of the invention is a wedge for a post tension anchor. According to this aspect of the invention, a wedge includes at least two circumferential wedge segments adapted to be placed on an exterior of a tendon. The wedge segments have an exterior surface adapted to cooperate with a load-transfer device, and an interior surface having gripping elements thereon. A circumferential dimension of the wedge segments is selected so that a total uncompressed gap between circumferential ends of the wedge segments when the segments are applied to an exterior surface of the tendon is at most about equal to 2.4 times the height of the gripping elements.

Another aspect of the invention is a reinforcement system. According to this aspect, a reinforcing system includes an anchor plate having at least one generally tapered bore therein. The system includes at least two circumferential wedge segments, each wedge segment defining an exterior tapered surface and an interior surface. The exterior surface is adapted to cooperatively engage with the at least one tapered bore on the anchor plate. The interior surface has gripping elements thereon. The system further includes a compression limiting device cooperatively engaged with the wedge segments. The compression limiting device is adapted to limit the lateral compression of the wedge segments when the segments are applied to an exterior surface of a tendon to at most about 2.4 times the height of the gripping elements.

Other aspects and advantages of the invention will be apparent from the following description and the appended claims.

DETAILED DESCRIPTION

Generally, the invention includes tendon retaining wedge segments and/or anchor plates formed to have particular features as will be explained below in more detail. Some embodiments of wedge segments and/or anchor plates according to the invention are intended to be used with post-tension anchor systems, and for purposes of illustrating the invention, a post tension anchor system will be explained. However, wedge segments and/or anchor plates according to various aspects of the invention may be used with any other application for a tendon system, including, without limitation, the various applications described in the Background section herein.

Figure 1:
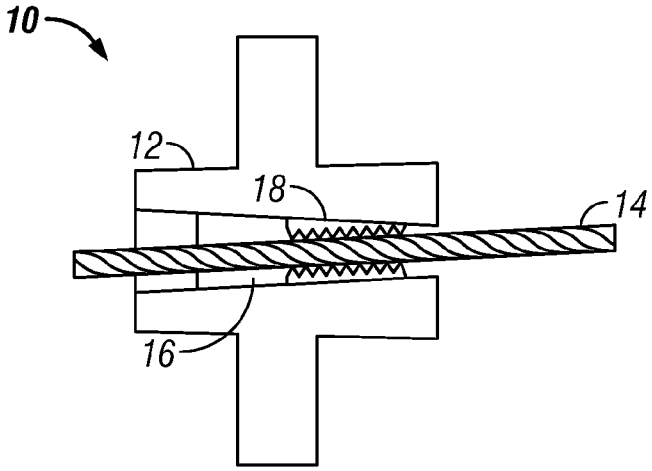
FIG. 1 shows a typical post tension anchor system.

An assembled post-tension anchor system and post-tension tendon are shown generally in cross section in FIG. 1. The anchor system 10 includes load transfer device called an anchor plate or anchor base 12, usually cast or forged from a ductile metal. The anchor plate 12 is adapted to be cast into or otherwise affixed to a concrete member (not shown in FIG. 1) that is to be reinforced using the tendon and anchor system. The anchor plate 12 includes a generally conically-shaped or tapered wedge receiving bore 16 for receiving and holding an anchor wedge 18. The anchor wedge 18 may be formed from two or more circumferential wedge segments, as will be explained below with reference to FIGS. 3 and 4, and includes on its inner surface a plurality of inwardly projecting gripping elements to penetrate and grip the outer surface of a reinforcing tendon 14. As axial tension (tension along the longitudinal axis of the tendon 14) is applied to the tendon 14, the conically shaped exterior surface of the wedge 18 and the correspondingly tapered inner surface of the receiving bore 16 cooperate to laterally squeeze the circumferential segments 18A of the wedge 18 together such that it grips the tendon 14 tightly, thus restraining the tendon 14 from axial movement. During assembly of the anchor system 10, the tendon 14 is axially stretched, and the wedge segments 18A are applied to the exterior of the tendon 14. When the tension is released from the tendon 14, the wedge 18 is pulled into the receiving bore 16 on the anchor plate 12. The anchor plate 12 thus serves the purpose of transferring tensile load from the tendon 14 so as to apply a compressive force to a concrete structure (not shown). In embodiments used in applications other than post-tension reinforcement, the function of the anchor plate 12 can performed by any other known type of load transfer device.

As the tendon 14 and wedge 18 are pulled axially into the receiving bore 16, the wedge segments 18A are laterally compressed against the tendon 14 by the action of the cooperating tapered outer surface of the wedge 18 and correspondingly tapered inner surface of the wedge receiving bore 16. It should be understood that in other embodiments, a different exterior surface, such as right cylindrical, for the wedge segments may be used, and the interior surface of the receiving bore may correspond in shape to such surface of the wedge segments. It is only required for purposes of the invention that the wedge segments cooperate with the exterior surface of the receiving bore (and any additional element which may be provided) to laterally compress the wedge segments into the exterior surface of the tendon. Examples of such other arrangements include lateral compression of the anchor or use of a ferrule-like device at one axial end of the wedge segments.

The anchor plate 12 shown in FIG. 1 includes only one receiving bore 16. However, other embodiments of an anchor plate may include any number of such receiving bores. The receiving bore configuration of the anchor 12 plate shown in FIG. 1 is therefore not intended to limit the scope of the invention.

Figure 2:
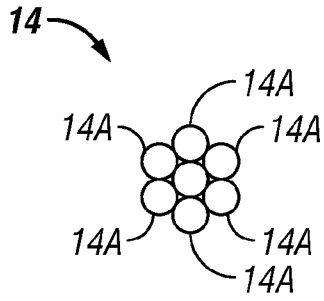
FIG. 2 shows a section of a typical tendon.

FIG. 2 shows an end view of a typical tendon 14. The tendon in this example is made from six, high tensile strength steel wires 14A, generally wound in a helical pattern around a centrally positioned, seventh wire 14A. In one embodiment, the wires 14A are made from steel having a tensile strength of 270,000 pounds per square inch (psi). Typically, the steel from which the wires 14A are made has a surface hardness in a range of about 40-54 Rockwell "C." The foregoing specifications for the wires 14A are only meant to serve as examples of wires that are used in post tension reinforcement systems, and are not intended to limit the scope of the invention. The foregoing description of the tendon is meant to serve only to explain the principle by which the invention works. Accordingly, as used in this description, the term "tendon" is intended to include any element which is placed under tensile stress under ordinary operation. The tensile stress is communicated, through the wedges, to a load transfer device, which in the present embodiment includes the anchor plate 12. The purpose of the load transfer device is to transfer the tensile stress in the tendon to a structure that is in contact with the load transfer device. Any tendon structure and/or material known in the art for use in such reinforcing systems may also be used in different embodiments, including, without limitation, single-strand tendons, steel bars, wire rope, composite (e.g. fiber reinforced plastic) tendons, guide wire and the like.

Figure 3:
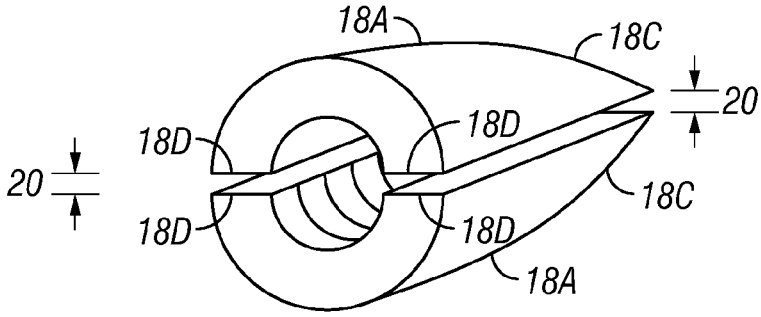
FIG. 3 (Prior Art)
FIG. 3 shows a prior art retaining wedge.

FIG. 3 shows an example of a prior art wedge 18 made from two circumferential wedge segments 18A, in order to more clearly delineate the novel features of a wedge made according to the invention. The wedge 18 is typically formed by machining, or forging, a single, truncated cone-shaped metal body (not shown separately in the Figures) from a soft steel alloy, although the process for forming the wedge body is not a limitation on the scope of the invention. A hole is typically drilled in the single, cone-shaped metal body (not shown), and then the gripping elements can be formed inside the hole. The gripping elements are typically formed by threading, however other structures and method for forming the gripping elements are known in the art. Typical threads known in the art for use on anchor wedges include so-called "buttress" threads, or may be other industry standard thread types known by designations "UNC" (unified coarse thread) or "UNF" (unified fine thread, also known as Society of Automotive Engineers—SAE thread). The threads are dimensionally defined by a pitch "P" (referring to the number of threads per unit length along the longitudinal axis of the threaded element) and a difference, denoted at "D" between the thread major diameter and the thread minor diameter, also referred to as "thread depth." Major diameter is the maximum diameter defined at the root (base or bottom of each thread) of the thread and the minor diameter is the minimum diameter defined at the crest of the thread (point or tip of each thread). As an example, the dimension D for threads known in the art used to support a 0.500 inch (12.7 mm) nominal outer diameter (OD) tendon (14 in FIG. 1) is about 0.021 inches (0.5 mm). The dimension D may also be referred to as the height of the gripping elements.

The single, cone shaped metal body (not shown separately) having the threaded hole (or other form of griping elements in such hole) is then separated into the two or more circumferential wedge segments such as the ones shown in FIG. 3 at 18A, resulting in wedge segments each having a tapered exterior surface 18C and an interior surface 18B which is typically threaded, so as to form the gripping elements to grip the tendon (14 in FIG. 1). After they are formed from the single metal body, the wedge segments 18A are typically case hardened to about 60 Rockwell "C" hardness so that the interior surface 18B having the gripping elements (threads) thereon can deform the exterior surface of the tendon (14 in FIG. 1) to enable gripping the tendon (14 in FIG. 1) as the wedge 18 is laterally compressed onto the tendon 14. Circumferential wedge segments as used herein means that the segments are formed by separation of the wedge body in a direction along its longitudinal axis.

Typically, the wedge segments 18A are formed by cutting the cone shaped, hole drilled and threaded metal body into segments. Preferably the wedge segments 18A are cut so as to be substantially the same dimensions as each other. Prior art wedge segments 18A are typically cut so that when the wedge segments 18A are applied to the exterior of the tendon (14 in FIG. 1), prior to insertion into the wedge receiving bore (16 in FIG. 1) in the anchor plate (12 in FIG. 1), there is a gap 20 between the circumferential ends 18D of adjacent wedge segments 18A. If there are two wedge segments in a wedge, there will be two such gaps in a single wedge. Depending on how symmetrically the individual wedge segments 18A are positioned about the exterior of the tendon (14 in FIG. 1), the gaps 20 between the wedge segments 18A may be equal in size, or may be unequal in size. However, wedge segments made according to methods and dimensions known in the art will provide a total gap (the sum of all the individual gaps between circumferential ends of all the wedge segments) which is greater than a total expected amount of diameter reduction (lateral compression) of the wedge 18 due to the gripping elements (the threads) penetrating the exterior surface of the tendon (14 in FIG. 1). Reduction in diameter of the wedge 18 occurs when the wedge 18 is laterally compressed by the wedge receiving bore (16 in FIG. 1) in the anchor plate (12 in FIG. 1), as previously explained. For purposes of describing the invention, "lateral compression" of the wedge may be defined as the reduction in diameter of the wedge from an uncompressed state to a compressed state. "Uncompressed state" means that the wedge segments are applied to the exterior of the tendon without force sufficient to substantially deform the metal of the exterior surface of the tendon. In some instances the radius of curvature of the wedge segments at the inner surface of the gripping elements, which is ordinarily substantially the same as that of the exterior of the tendon, may be slightly smaller than the exterior of the tendon, depending on, among other factors, the manufacturing tolerances of the tendon and the wedge segments. Some metal deformation may take place in such cases when the wedge segments are applied to the tendon prior to lateral compression in the anchor plate, but the condition still fits the description of "substantially no deformation" of the surface of the tendon. "Compressed state" includes any compressive force applied to the wedge sufficient to substantially deform the metal of the tendon, thus seating the wedge segments on the tendon, by means of the gripping elements deforming the surface of the tendon around a substantial portion of the circumference of the tendon.

The purpose of the gap dimensions known in the prior art was to avoid having the circumferential ends 18D of the wedge segments come into compressional contact with each other when the wedge 18 was engaged in the wedge receiving bore (16 in FIG. 1) under substantial to full load tensile stress on the tendon (14 in FIG. 1). It was believed with respect to prior art wedges that compressional contact of the circumferential ends of the wedge segments would result in premature failure of the load transfer device, resulting in a "pullout", meaning failure of the wedge to properly grip the tendon (14 in FIG. 1) and thus allowing axial movement of the tendon (14 in FIG. 1) relative to the wedge, i.e., failure of the tendon/anchor system itself.

Using the previous example of a prior art wedge, for a nominal 0.500 inch OD tendon, and using 0.021 inch depth threads on the wedge 18, it would be expected that the wedge 18 would be reduced in diameter by at least 0.042 inches from an uncompressed state to fully laterally compressed when pulled into the wedge receiving bore (16 in FIG. 1). Typically, wedge segments 18A known in the art are cut or formed so that in the uncompressed state the total gap (sum of individual gaps 20) between all circumferential ends 18D is at least 0.063 inches.

With reference to prior art wedges, it is believed that a source of the failure of the tendon during axial stress testing is a reduction of the effective external diameter of the tendon and the formation of stress risers resulting from relatively deep penetration of the surface of the tendon (14 in FIG. 1) by the threads on the wedge segments 18A, and corresponding extrusion of the tendon material. In typical prior art anchor systems, it has been determined through testing to failure that the point of failure of the tendon (14 in FIG. 1) is frequently at an axial position near the first thread (gripping element) on the wedge 18. Testing to failure also demonstrates that the typical mode of failure is for only one of the wires (14A in FIG. 2) in a 7 wire PC strand tendon (such as shown in FIG. 2) to fail prior to the other wires. This failure mode results in prior art anchor systems being frequently unable to meet revised testing standards.

Figure 4:
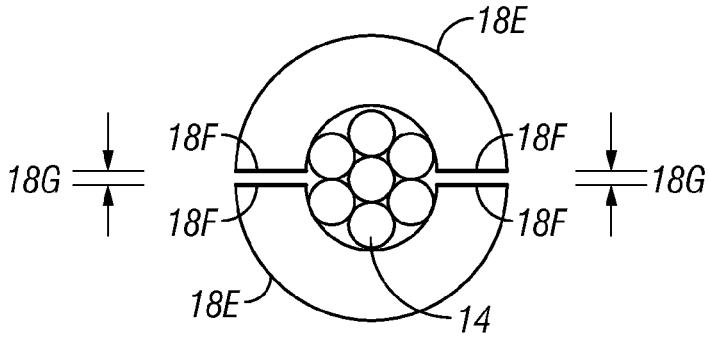
FIG. 4 shows one embodiment of a retaining wedge according to the invention.

FIG. 4 shows wedge segments 18E made according to one embodiment of the invention. The wedge segments 18E have nominal axial length, taper angle on the outer surface and thread dimensions similar to wedges known in the art. Wedge segments according to the invention, however, have circumferential dimensions selected so that the total uncompressed gap 18G (the gap prior to lateral compression in the wedge receiving bore 16) between the circumferential ends 18F of the wedge segments 18E is at most equal to about 2.4 times the height of the gripping elements.

Using the example of a tendon retaining (anchoring) system for a nominal 0.500 inch OD tendon, and using 0.021 inch depth threads, a total maximum uncompressed gap would be about 0.050 inches. In some embodiments, the minimum uncompressed gap is about 0.24 times the height of the gripping elements, or thread depth, thus providing a preferred range of total uncompressed gap of about 0.24 to 2.4 times the height of the gripping elements.

More preferably, it has been determined through experimentation that an uncompressed gap 18G within a range of about 0.4 to 1.8 times the height of the gripping elements can provide a breaking strength of the anchor system equal to as much as 100 percent of the rated failure strength of the tendon.

In the present example for 0.021 inch thread depth, an optimum uncompressed gap can be about 0.008 to 0.038 inches. It should be noted that after compression of the wedge 18 into the wedge receiving bore (16 in FIG. 1), there is no gap between the circumferential edges of the wedge segments, and the edges can reasonably be inferred to be in compression against each other. Such compression was previously thought to be detrimental to the function of the wedge, however it has been determined through experiment that with reasonable limitation such compression is actually beneficial to the operation of the anchor system overall.

In another aspect, a retaining wedge made according to the invention may have a limited axial dimension (length along the longitudinal axis) while still providing high pullout and tendon breaking strength to an anchored tendon. In the prior art, it was believed that in order to reduce the possibility of pullout or tensile failure of the tendon, it was necessary to increase the overall length of the wedge and corresponding receiving bore in the anchor. It has been determined through experimentation with anchor wedges made according to the invention that the overall length of the wedge may be limited to at most about 2.3 times the nominal diameter of the retained tendon. In the present example, a wedge made to retain a nominal 0.500 inch OD tendon would have an overall length of at most about 1.155 inches. Other nominal diameters would have wedge lengths limited proportionately.

Figure 5:
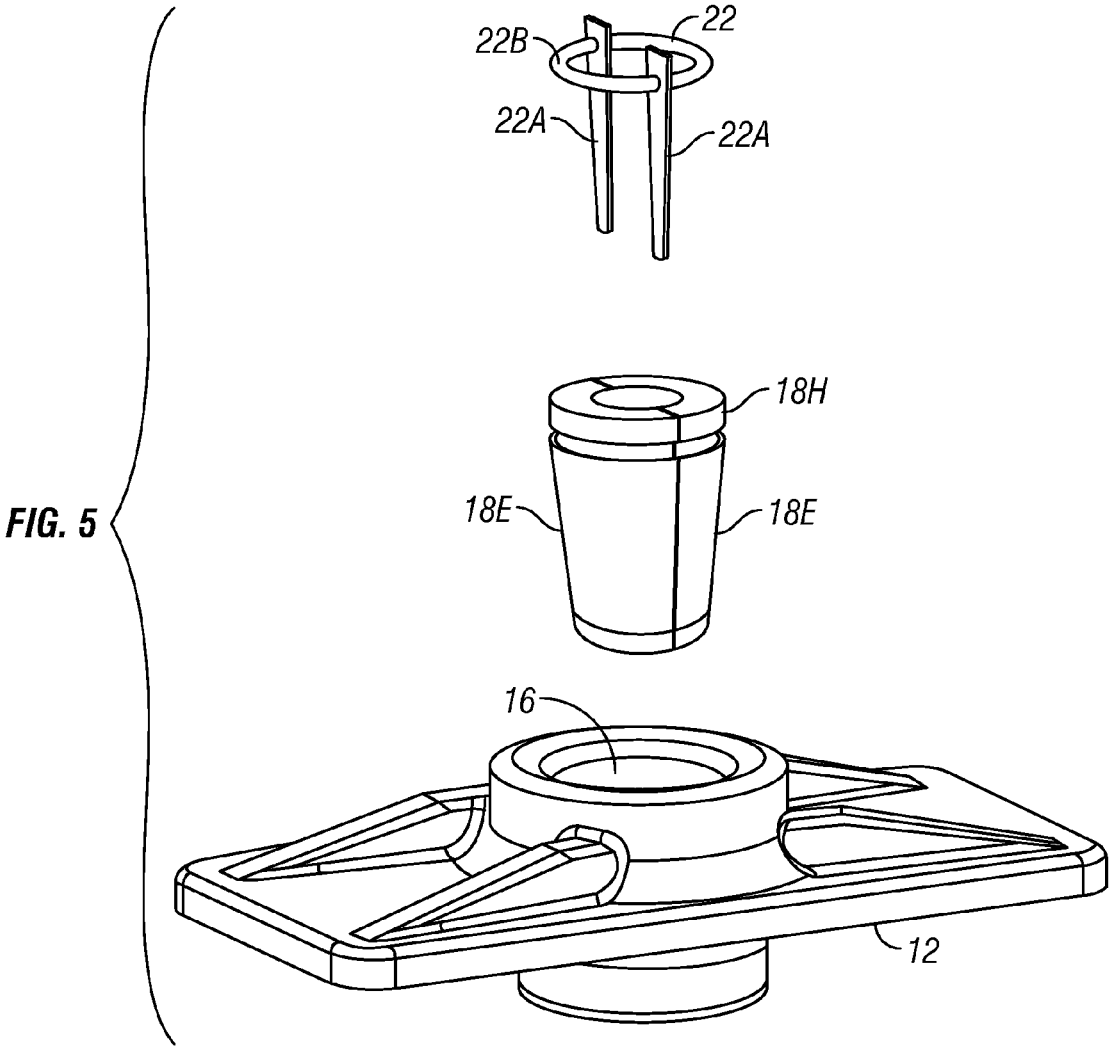
FIG. 5 shows another embodiment of a wedge and anchor according to the invention.

Another embodiment of the invention is shown in exploded view in FIG. 5. An anchor plate 12 may have a conventional, tapered wedge receiving bore 12, according to structures known in the art for anchor plates. Wedge segments 18A may be formed according to methods and structures known in the art. In the present embodiment, as well as in other embodiments, the wedge segments 18A may include a retainer groove 18H on the exterior surface. The present embodiment includes a spacer element 22 having a retaining ring 22B on an end adapted to be placed in contact with the large-diameter end of the wedge segments 18A. Longitudinally projecting tangs 22A are adapted to fit within the gaps (18G in FIG. 4) between the circumferential ends of the wedge segments 18A. Thickness of the tangs 22A and the uncompressed gaps of the circumferential ends of the wedge segments 18A may be selected to limit the lateral compression of the wedge segments 18A when the wedge segments 18A are pulled axially into the wedge receiving bore. In combination, the thickness of the tangs 22A, and the uncompressed gaps may be selected to have uncompressed total gap thickness between the tangs 22A and circumferential ends of about 0.24 to 2.4 times the thread depth. More preferably, the total uncompressed gap is within a range of about 0.4 to 1.8 times the thread depth. In principle, the embodiment shown in FIG. 5 functions similarly to the previous embodiment, explained with reference to FIG. 4. The present embodiment makes use of the spacer element 22 to control the uncompressed gap (and thus lateral compression) of the wedge segments 18A, rather than making the wedge segments themselves so as to have the selected uncompressed gap. The spacer element 22 can be configured as shown in FIG. 5 for ease of installation and reliability of the spacer element remaining in place during assembly of the wedge to the tendon and anchor plate. It should be understood that the purpose of the spacer element 22 may be performed by a single shim or similar spacer inserted into one or more of the circumferential gaps between wedge segments, and that the embodiment of FIG. 5 is not intended to represent every possible means for controlling a total uncompressed gap between wedge segments.

Figure 6:
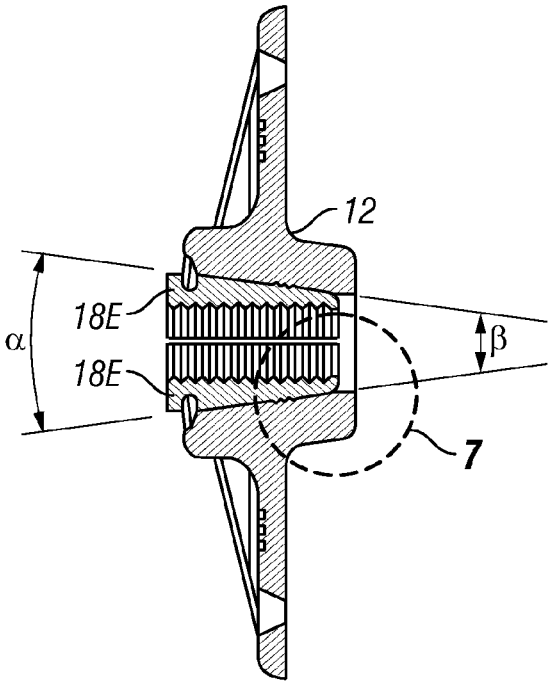
FIG. 6 shows another embodiment of the invention.
Figure 7:
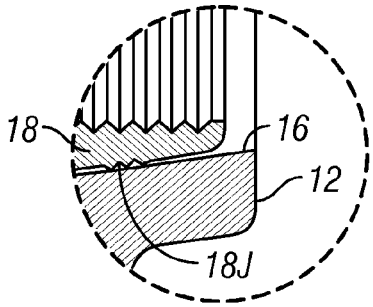
FIG. 7 shows a detailed view of a wedge axial travel limiting device according to the invention.

Another embodiment is shown in and will be explained with reference to FIGS. 6 and 7. The anchor plate in FIG. 7 has a wedge receiving bore 14 which subtends an angle $\beta$ that is somewhat less tapered than the angle a subtended by the exterior surface of the wedge 18. In the present embodiment, the wedge 18 exterior surface taper is about 14 degrees (7 degrees per side from the longitudinal axis) and the wedge receiving bore 16 taper is about 12 degrees. FIG. 7 shows a portion of the wedge near the narrow end thereof in detail. The wedge 18 include serrations 18J to grip the wedge in a position away from the nose end (the small diameter longitudinal end) of the wedge 18. The purpose of the selection of tapers for the wedge 18 and the wedge receiving bore 16 in cooperation with the serrations 18J is to limit axial travel of he wedge 18 into the bore 16, thereby limiting the lateral compression of the wedge 18. Limiting lateral compression of the wedge 18 can limit the penetration of the gripping elements (18B in FIG. 3) into the exterior surface of the tendon (14 in FIG. 1), thus reducing the possibility of tensile failure thereof. In various implementations of a system according to the embodiment of FIGS. 6 and 7, the taper angles $\alpha$, $\beta$ and the position and depth of the serrations 18J are preferably selected to limit axial movement of the wedge segments such that the total lateral compression (and corresponding reduction in diameter) of the wedge is at most equal to about 2.4 times the thread depth or gripping element height. More preferably, the axial motion of the wedge is limited such that the lateral compression is in a range of about 0.24 to 2.4 times the height of the gripping elements, and mot preferably within a range of about 0.4 to 1.8 times the height of the gripping elements.

Figure 8:
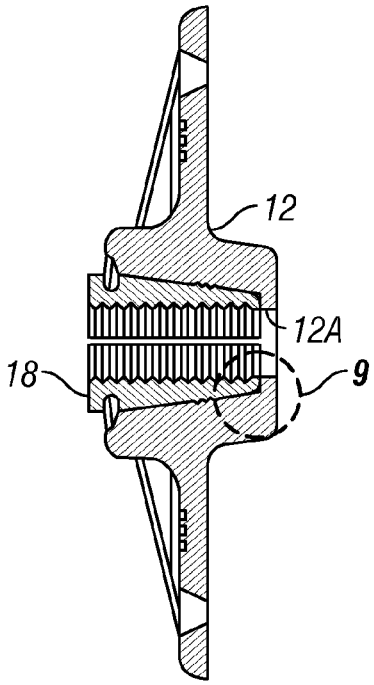
FIG. 8 shows another embodiment of the invention.
Figure 9:
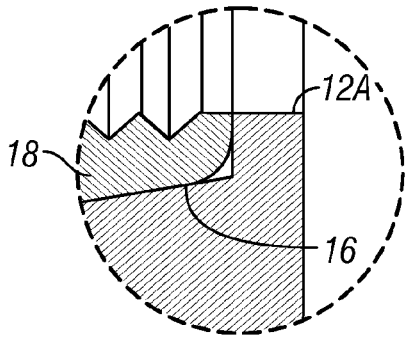
FIG. 9 shows a detailed view of a wedge axial travel limiting device according to the invention.
Figure 10:
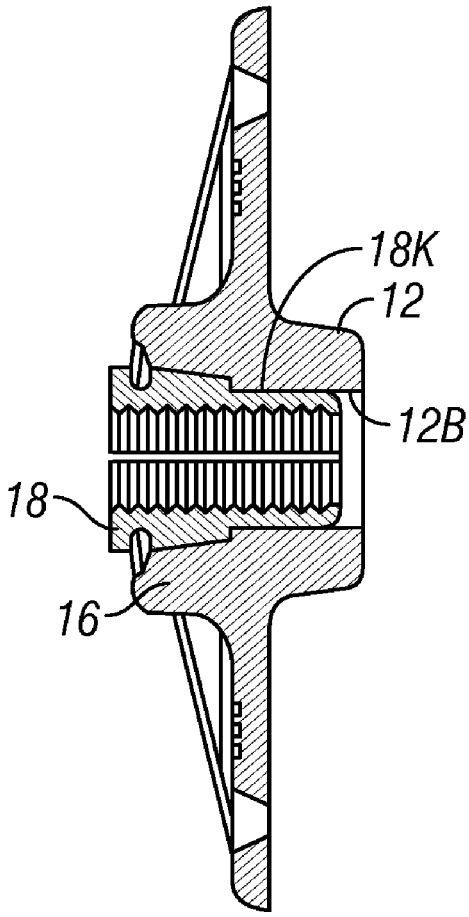
FIG. 10 shows another embodiment of the invention.

Alternative embodiments of a device to limit axial movement of the wedge 18 are shown in FIGS. 8, 9 and 10. FIGS. 8 and 9 show an axial stop ring 12A formed into the interior surface of the small-diameter end of the wedge receiving bore 16. The stop ring 12A is positions so as to serve to limit axial motion of the wedge 18. Axial motion of the wedge should be limited to a position such that the lateral compression of the wedge 18 is limited to at most the thread depth of the gripping elements (18B in FIG. 3). Alternatively, as shown in FIG. 10, an axial motion stop element may be in the form of a shoulder 12B formed into the wedge receiving bore 16. The shoulder 12B may define an axial end of a reduced diameter portion of the wedge receiving bore 16. A cylindrical (untapered) portion 18K of the wedge 18 may be formed to cooperate with the cylindrical portion 12B so as to guide the wedge 18 into the bore 16. While the foregoing embodiments show a stop ring or shoulder near the nose (small diameter) end of the wedge, other embodiments may include a corresponding feature at different axial positions along the wedge. Various implementations of the foregoing embodiments are intended to limit axial motion of the wedge such that a total lateral compression of the wedge (and corresponding reduction in diameter) is at most equal to about 0.24 to 2.4 times the height of the gripping elements, and more preferably 0.4 to 1.8 times the height of the gripping elements.

The foregoing embodiments include one or more types of device to limit the lateral compression of the wedge such that it cannot be reduced in diameter less than a height of the gripping elements on the interior surface of the wedge. It is believed that limiting the lateral compression in the manner described will increase the ultimate strength of the tendon when retained in the anchor.

The foregoing embodiments, as previously explained, are described with respect to post-tension concrete reinforcing systems. It should be understood that other applications for tendon anchoring, such as mine wall and/or roof retention, bridge supports, wall supports, and other tendon retaining systems such as described in the Background section herein may have application for a tendon retaining system according to the invention to improve the tensile strength thereof While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A post tensioned concrete tendon retaining wedge, comprising:

at least two circumferential wedge segments adapted to be placed on an exterior of a tendon, the wedge segments having an exterior surface adapted to cooperate with a receiving bore in a load transfer device, the wedge segments having an interior surface having gripping elements thereon, a circumferential dimension of the wedge segments selected so that a total uncompressed gap between circumferential ends of the wedge segments when the segments are applied to an exterior surface of the tendon at most 2.4 times a height of the gripping elements, wherein an exterior surface of the tendon and an interior surface of the gripping elements define substantially the same radius of curvature, such that when the wedge segments are laterally compressed against the tendon, the circumferential ends of the wedge segments contact each other.

2. The wedge of claim 1 wherein the uncompressed gap is within a range of about 0.24 to at most 2.4 times the height of the gripping elements.

3. The wedge of claim 1 wherein the uncompressed gap is within a range of about 0.4 to 1.8 times the height of the gripping elements.

4. The wedge of claim 1 wherein the uncompressed gap is at most 0.050 inches for a nominal 0.500 inch outer diameter tendon.

5. The wedge of claim 4 wherein the uncompressed gap is at most 0.021 inches.

6. The wedge of claim 1 wherein the gripping elements comprise threads.

7. The wedge of claim 6 wherein the threads comprise buttress threads.

8. A post tensioned concrete reinforcement system, comprising: an anchor plate having at least one generally tapered bore therein; and at least two circumferential wedge segments, each segment defining an exterior tapered surface and an interior surface, the exterior surface adapted to cooperatively engage with the at least one tapered bore on the anchor plate, the interior surface having gripping elements thereon, a circumferential dimension of the wedge segments selected so that a total uncompressed gap between circumferential ends of the wedge segments when the segments are applied to an exterior surface of a tendon is at most 2.4 times a height of the gripping elements, wherein an exterior surface of the tendon and an interior surface of the gripping elements define substantially the same radius of curvature, such that when the wedge segments are laterally compressed against the tendon, the circumferential ends of the wedge segments contact each other.

9. The system of claim 8 wherein the uncompressed gap is within a range of about 0.24 to at most 2.4 times the height of the gripping elements.

10. The system of claim 8 wherein the uncompressed gap is at most 0.4 to 1.8 times the height of the gripping elements.

11. The system of claim 10 wherein the uncompressed gap is at most 0.021 inches.

12. The system of claim 8 wherein the gripping elements comprise threads.

13. The system of claim 12 wherein the threads comprise buttress threads.

14. A post tensioned concrete reinforcement system, comprising:

an anchor plate having at least one generally tapered bore therein;

at least two circumferential wedge segments, each segment defining an exterior tapered surface and an interior surface, the exterior surface adapted to cooperatively engage with the at least one tapered bore on the anchor plate, the interior surface having gripping elements thereon; and a compression limiting device cooperatively engaged with the wedge segments, the compression limiting device configured to limit lateral compression of the wedge segments when the segments are applied to an exterior surface of a tendon to at most 2.4 times a height of the gripping elements.

15. The system of claim 14 wherein the lateral compression of the wedge segments is limited to within a range of about 0.24 to at most 2.4 times the height of the gripping elements.

16. The system of claim 15 wherein the lateral compression of the wedge segments is limited to within a range of 0.4 to 1.8 times the height of the gripping elements.

17. The system of claim 14 wherein the gripping elements comprise threads.

18. The system of claim 17 wherein the threads comprise buttress threads.

19. The system of claim 14 wherein the compression limiting device comprises at least one spacer adapted to be disposed between circumferential ends of the wedge segments, a thickness of the at least one spacer and gaps between circumferential ends of the wedge segments selected to limit the lateral compression.

20. The system of claim 14 wherein the compression limiting device comprises a device for limiting axial motion of the wedge segments into the anchor.

21. The system of claim 20 wherein the axial motion limiting device comprises a taper angle subtended by the tapered bore that is less than a corresponding taper angle subtended by the exterior surface of the wedge segments, the axial motion limiting device further comprising serrations on the exterior surface of the wedge segments.

22. The system of claim 20 wherein the axial motion device comprises a shoulder formed into the tapered bore cooperatively engaged with the wedge segment to limit axial motion thereof.

23. A post tensioned concrete reinforcement system, comprising:

at least two circumferential wedge segments adapted to be placed on an exterior of a tendon, the wedge segments having an exterior surface adapted to cooperate with a receiving bore in a load transfer device, the wedge segments having an interior surface having gripping elements thereon, a circumferential dimension of the wedge segments selected so that a total uncompressed gap between circumferential ends of the wedge segments when the segments are applied to an exterior surface of the tendon at most 2.4 times a height of the gripping elements wherein an exterior surface of the tendon and an interior surface of the gripping elements define substantially the same radius of curvature, an axial length of the wedge segments equal to at most 2.3 times a nominal diameter of the tendon, such that when the wedge segments are laterally compressed against the tendon, the circumferential ends of the wedge segments contact each other.

24. The system of claim 23 wherein the uncompressed gap is within a range of about 0.24 to at most 2.4 times the height of the gripping elements.

25. The system of claim 23 wherein the uncompressed gap is within a range of about 0.4 to 1.8 times the height of the gripping elements.

26. The system of claim 23 wherein the uncompressed gap is at most 0.050 inches for a nominal 0.500 inch outer diameter tendon.

27. The system of claim 26 wherein the uncompressed gap is at most 0.021 inches.

28. The system of claim 23 wherein the axial length is at most 1.15 inches for a nominal 0.500 inch outer diameter tendon.

29. The system of claim 23 wherein the gripping elements comprise threads.

30. The system of claim 29 wherein the threads comprise buttress threads.

* * * * *